US005225270A

United States Patent [19]

Bhoori et al.

[11] Patent Number: 5,225,270

[45] Date of Patent: Jul. 6, 1993

[54] COMPATIBILIZED POLYPHENYLENE ETHER/POLYAMIDE MONOFILAMENT AND FELT MADE THEREFROM

[75] Inventors: Yousuf M. Bhoori, Edison; Daniel S. Leydon, Cedar Knolls; Clark W. Smith, Bloomingdale, all of N.J.

[73] Assignee: Allied-Signal Inc., Morristown, N.J.

[21] Appl. No.: 814,977

[22] Filed: Dec. 24, 1991

[51] Int. Cl.[5] ..... D04H 1/08; B32B 19/00; D02G 3/00; C08F 283/08

[52] U.S. Cl. ..... 428/280; 428/357; 428/364; 428/365; 525/390; 525/391; 525/396; 525/397

[58] Field of Search ..... 525/390, 391, 396, 397; 428/357, 364, 365, 280

[56] References Cited

U.S. PATENT DOCUMENTS

| | | | |
|---|---|---|---|
| 3,306,875 | 2/1967 | Hay . | |
| 3,337,501 | 8/1967 | Bussink et al. . | |
| 3,379,792 | 4/1968 | Finholt . | |
| 3,480,580 | 11/1969 | Joyner et al. . | |
| 3,481,910 | 12/1969 | Brunson . | |
| 3,613,258 | 10/1971 | Jamieson . | |
| 3,787,361 | 1/1974 | Nakashio et al. . | |
| 4,119,753 | 10/1978 | Smart . | |
| 4,159,618 | 7/1979 | Sokaris et al. . | |
| 4,315,086 | 2/1982 | Ueno et al. . | |
| 4,359,501 | 11/1982 | DiTullio . | |
| 4,427,734 | 1/1984 | Johnson . | |
| 4,600,741 | 7/1986 | Aycock et al. | 525/151 X |
| 4,612,155 | 9/1986 | Wong . | |
| 4,732,938 | 3/1988 | Grant et al. . | |
| 4,751,270 | 6/1988 | Urawa et al. . | |
| 4,873,276 | 10/1989 | Fuji et al. . | |
| 4,973,512 | 11/1990 | Stanley et al. . | |
| 4,995,429 | 2/1991 | Kositzke . | |
| 5,069,818 | 12/1991 | Aycock et al. | 525/390 X |
| 5,073,620 | 12/1991 | Sanada et al. | 525/132 X |
| 5,084,511 | 1/1992 | Abe et al. | 525/68 |
| 5,104,939 | 4/1992 | van der Meer et al. | 525/92 |

OTHER PUBLICATIONS

Encyclopedia of Chemical Technology, vol. 18, pp. 328–436, 1984.

*Primary Examiner*—George F. Lesmes
*Assistant Examiner*—Terrel Morris
*Attorney, Agent, or Firm*—Michael U. Lee; Roger H. Criss

[57] ABSTRACT

According to the present invention, there is provide a monofilament, based on the total weight of the monofilament composition, (a) from about 70 weight % to about 30 weight % of a polyphenylene ether, (b) from about 30 weight % to about 70 weight % of a polyamide, (c) from about 0.1 weight % to about 2.0 weight % of a compatibilizer compound for (a) and (b), and (d) from about 1 weight % to about 35 weight % of a functionalized olefinic elastomer, and industrial conveyer belts fabricated therefrom.

18 Claims, No Drawings

COMPATIBILIZED POLYPHENYLENE ETHER/POLYAMIDE MONOFILAMENT AND FELT MADE THEREFROM

BACKGROUND OF THE INVENTION

1. Field of the Invention

The present invention relates to a polymeric monofilament and to a felt fabricated therefrom.

2. Description of the Prior Art

Polymeric monofilaments, in general, are produced by an extrusion process as is well known in the art. A polymeric resin is melt-extruded by an extruder equipped with a monofilament die into continuous strands of molten monofilaments. The resulting monofilaments are immediately quenched in a waterbath to form solid monofilaments. Thereafter, the solid monofilaments are subjected to an orientation process, which includes one or more steps of alternatingly heat stretching and quenching procedures, in order to impart physical strength.

Woven endless belts for conveying and guiding products under manufacture, which are utilized in various industrial processes, are one group of numerous applications where polymeric monofilaments are used extensively. Many of such conveyer belt applications involve harsh chemical and temperature environments in which ordinary polymeric materials cannot withstand. Papermaking machine felts are examples of such applications.

A papermaking machine, in essence, is a device for sequentially removing water from the paper furnish. A typical papermaking-machine is divided into three sections: forming, wet-press, and dryer sections. In the forming section, the slurry of paper furnish and water is deposited on a forming grid and water is drained, leaving a paper web of about 75 weight percent water content. The resulting web is carried into the wet-press section on a felt (wet-press felt) and passed through one or more of nip presses to reduce the water content of the web to below about 65 weight percent. The web is then carried to the dryer section and dried by contacting hot dryer cylinders on a felt (dryer felt) to reduce the water content of the web to below about 8 weight percent.

Although the felts for different sections of papermaking machine must be designed and fabricated to meet specific needs essential to each section, the felts must possess the general characteristics of dimensional stability, resistance to chemical and thermal degradations, resistance to abrasion, resiliency and tenacity. Both metal and synthetic polymers have been used to fabricate the felts with varying degree of success. Metal fabric felts provide superior thermal characteristics, but are difficult to handle, have poor flexure resistance and are prone to chemical attack and corrosion. These disadvantageous characteristics of metal fabric felts led to a wide acceptance of fabric felts made from a variety of synthetic polymers such as polyolefins, polyamides and polyesters. However, such synthetic polymer felts also exhibit certain disadvantages. Polyolefin felts, for example, are dimensionally stable but have low thermal stability and are not resistant to the chemicals utilized in the papermaking process. Felts made from polyesters provide dimensional stability, and are resistant to abrasion and chemicals, but are prone to high temperature hydrolysis. Felts made from polyamides, such as nylon 6 and nylon 6,6, provide abrasion resistance, resiliency and tenacity, but do not have the required dimensional stability.

There are many commercially available specialized synthetic polymers that are useful for the felt application. Currently, one of the most widely used synthetic polymers to fabricate felts for papermaking machines are long-chain polyamides such as nylon 6/10 and nylon 6/12. The long-chain polyamides provide tenacity, resiliency and abrasion resistance as well as dimensional stability. Polyaryletherketone fabrics also have been utilized in the felt applications as disclosed in U.S. Pat. 4,359,501 to DiTullio. U.S. Pat. 4,159,618 to Sokaris discloses yarns fabricated from liquid-crystal polymers, such as aramides, that are useful in the manufacture of woven felts. Although these specialty polymer felts provide good properties that are required in the papermaking felt applications, the high cost of these specialty polymers precludes wide acceptance of such felts. Consequently, it is desirable to have less expensive polymeric materials that exhibit the required characteristics suitable for the felt application.

SUMMARY OF THE INVENTION

According to the present invention, there is provided a monofilament comprising, based on the total weight of the monofilament, (a) from about 70 weight % to about 30 weight % of a polyphenylene ether, (b) from about 30 weight % to about 70 weight % of a polyamide, (c) from about 0.1 weight % to about 2.0 weight % of a compatibilizer compound for (a) and (b), and (d) from about 1 weight % to about 35 weight % of a functionalized olefinic elastomer.

There is further provided in accordance with this invention a felt formed from a monofilament comprising, based on the total weight of the felt, (a) from about 70 weight % to about 30 weight % of a polyphenylene ether, (b) from about 30 weight % to about 70 weight % of a polyamide, (c) from about 0.1 weight % to about 2.0 weight % of a compatibilizer compound for (a) and (b), and (d) from about 1 weight % to about 35 weight % of a functionalized olefinic elastomer.

The monofilament of the present invention is a less costly polymeric monofilament having dimensional stability, abrasion resistance, chemical resistance, hydrolysis resistance and high temperature stability as well as strength and tenacity. The felt of the present invention provides excellent chemical and thermal characteristics that are suitable for varied industrial conveyer belt applications, including the papermaking machine felt applications.

DETAILED DESCRIPTION OF THE INVENTION

As mentioned above, the monofilament of the present invention comprises, based on the total weight of the monofilament, (a) from about 70 weight % to about 30 weight %, more preferably from about 60 weight % to about 40 weight %, of a polyphenylene ether, (b) from about 30 weight % to about 70 weight %, more preferably from about 40 weight % to about 60 weight %, of a polyamide, (c) from about 0.1 weight % to about 2.0 weight %, more preferably from about 0.2 weight % to about 1.0 weight percent, of a compatibilizer compound for (a) and (b), and (d) from about 1 weight % to about 35 weight %, more preferably about 2 weight % to about 30 weight percent, of a functionalized olefinic elastomer. The preferred monofilament of the present invention is characterized by having a tenacity of at least 3.5 gram per denier (gpd), more preferably at least 4 gpd, as measured by the ASTM 2256-90 breaking tenacity procedure. The instant monofilament offers dimensional stability, abrasion resistance, chemical resistance, hydrolysis resistance and high temperature stability as well as strength and tenacity, rendering the monofilament to be an excellent polymeric material for use in the industrial conveyer belt applications where the belt is exposed to chemically and thermally harsh environments.

One component of the present monofilament is a polyphenylene ether. Polyphenylene ethers are amorphous, non-polar polymers having excellent electrical and mechanical properties, heat and hydrolysis resistances, and dimensional stability. The polyphenylene ethers useful in the present invention include homopolymers and copolymers represented by the formula:

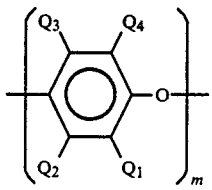

wherein $Q_1$ through $Q_4$ are selected independently of one another from the group consisting of hydrogen and hydrocarbon radicals and m denotes a number of at least 30. The polyphenylene ethers can be formed by any of a number of catalytic and non-catalytic processes from corresponding phenols or reactive derivative thereof. Examples of such processes of preparing polyphenylene ethers are described in U.S. Pat. Nos. 3,306,875; 3,337,501; and 3,787,361.

Specific examples of suitable substrate phenol compounds include phenol; o-,m-, or p-cresol; 2,6-, 2,5-, 2,4-, or 3,5-dimethylphenol; 2-methyl-6-phenylphenol; 2,6-diphenyl-phenol; 2,6-diethylphenol; 2-methyl-6-ethylphenol; and 2,3,5-,2,3,6- or 2,4,6-trimethylphenol. These phenol compounds may be used as a mixture. Other phenol compounds which can be used include dihydric phenols (e.g., bisphenol A, tetrabromobisphenol A, resorcinol, and hydroquinone).

Preferred polyphenylene ethers suitable for the present invention include poly(2,6-dimethyl-1,4-phenylene ether), poly (2-methyl-1,4-phenylene ether), poly (3-methyl-1,4-phenylene ether), poly(2,6-diethyl-1,4-phenylene ether), poly (2,6-dipropyl-1,4-phenylene ether), poly(2-methyl-6-alkyl-1,4-phenylene ether), poly(2,6-dichloromethyl-1,4-phenylene ether), poly(2,3,6-trimethyl-1,4-phenylene ether), poly (2,3,5,6-tetramethyl-1,4-phenylene ether), poly(2,6-dichloro -1,4-phenylene ether), poly(2,6-diphenyl-1,4-phenylene ether), poly(2,5-dimethyl-1,4-phenylene ether), and blends and copolymers thereof. Of these, the preferred polyphenylene is poly(2,6-dimethyl-1,4-phenylene ether). Useful polyphenylene ethers have a number average molecular weight of from 10,000 to 75,000. The intrinsic viscosity (IV) as measured in a chloroform solution typically ranges from 0.3 to 0.85 and preferably from 0.4 to 0.6.

Another component of the present monofilament is a polyamide. Polyamides, also commonly known in the art as nylons, are semi-crystalline, polar polymers having abrasion resistance, strength, toughness and solvent resistance as well as good processibility. The polyamides suitable for the present invention include those which may be obtained by the polymerization of a diamine having two or more carbon atoms between the amine terminal groups with a dicarboxylic acid, or alternately those obtained by the polymerization of a monoamino carboxylic acid or an internal lactam thereof. General procedures useful for the preparation of polyamides are well known to the art, and the details of their formation are well described, for example, under the heading "Polyamides" in the Encyclopedia of Chemical Technology published by John Wiley & Sons, Inc, Vol. 18, pps.328–436, (1984).

Suitable lactams that can be polymerized to produce polyamides include lactam monomers having about 3 to about 12 or more carbon atoms, preferably from about 5 to about 12 carbon atoms. Non-limiting examples of such lactam monomers include propiolactam, epsilon-caprolactam, pyrollidone, poperodone, valerolactam, caprylactam, lauryllactam, etc. Suitable polycaprolactam can be homopolymers of one of the above or similar lactam monomers, or copolymers of two or more of the lactam monomers.

Suitable diamines include those having the formula $$H_2N(CH_2)_nNH_2$$

wherein n preferably is an integer of 1–16, and includes such compounds as trimethylenediamine, tetramethylenediamine, pentamethylenediamine, hexamethylenediamine, octamethylenediamine, decamethylenediamine, dodecamethylenediamine, and hexadecamethylenediamine; aromatic diamines such as p-phenylenediamine, m-xylenediamine, 4,4'-diaminodiphenyl ether, 4,4'-diaminodiphenyl sulphone, 4,4'-diaminodiphenylmethane, alkylated diamines such as 2,2-dimethylpentamethylenediamine, 2,2,4-trimethylhexamethylenediamine, and 2,4,4-trimethylpentamethylenediamine, as well as cycloaliphatic diamines, such as diaminodicyclohexylmethane, and other compounds.

The dicarboxylic acids useful in the formation of polyamides are preferably those which are represented by the general formula $$HOOC—Z—COOH$$

wherein Z is representative of a divalent aliphatic radical containing at least 2 carbon atoms, such as adipic acid, sebacic acid, octadecanedioic acid, pimelic acid, subeic acid, azelaic acid, undecanedioic acid, and glutaric acid; or a divalent aromatic radical, such as isophthalic acid and terephthalic acid.

By means of example, suitable polyamides include: polypropiolactam (nylon 3), polypyrollidone (nylon 4), polycaprolactam (nylon 6), polyheptolactam (nylon 7), polycaprylactam (nylon 8), polynonanolactam (nylon 9), polyundecaneolactam (nylon 11), polydodecanolactam (nylon 12), poly(tetramethylenediamine-co-adipic acid) (nylon 4,6), poly(tetramethylenediamine-co-isophthalic acid) (nylon 4,I), polyhexamethylenediamine adipamide (nylon 6,6), polyhexamethylene azelaiamide (nylon 6,9), polyhexamethylene sebacamide (nylon 6,10), polyhexamethylene isophthalamide (nylon 6,I), polyhexamethylene terephthalamide (nylon 6,T), polymetaxylene adipamide (nylon MXD:6), poly (hexamethylenediamine-co-dodecanedioic acid) (nylon 6,12), poly(decamethylenediamine-co-sebacic acid) (nylon 10,10), poly(dodecamethylenediamine-co-dodecanedioic acid) (nylon 12,12), poly(bis[4-aminocyclohexyl]methane-co-dodecanedioic acid) (PACM-12), as well as copolymers of the above polyamides. By way of illustration and not limitation, such polyamide copolymers include: caprolactam-hexamethylene adipamide (nylon 6/6,6), hexamethylene adipamide-caprolactam (nylon 6,6/6), hexamethylene adipamide/hexamethylene-isophthalamide (nylon 6,6/6IP), hexamethylene adipamide/hexamethylene-terephthalamide (nylon 6,6/6T), trimethylene adipamide-hexamethylene-azelaiamide (nylon trimethyl 6,2/6,2), and hexamethylene adipamide-hexamethylene-azelaiamide caprolactam (nylon 6,6/6,9/6) as well as others polyamide copolymers which are not particularly delineated here. Blends of two or more polyamides may also be employed.

The preferred polyamides suitable for use in the present invention are polycaprolactam (nylon 6), polyhexamethylene adipamide (nylon 6/6), and copolymers and blends thereof. Preferably, the caprolactam-based polyamides suitable for use in the present invention exhibit a number average molecular weight, which is determined by the formic acid viscosity method, of between about 10,000 and about 60,000; more preferably, the polyamides exhibit a number average molecular weight of between about 15,000 and about 45,000.

Although polyphenylene ethers and polyamides provide useful physical and chemical properties as mentioned above, both polymers also exhibit disadvantageous characteristics. For example, polyphenylene ethers are brittle, highly viscous polymers, and polyamides are hygroscopic, dimensionally unstable polymers. In order to complementarily improve chemical and physical characteristics of the two polymers, numerous attempts have been made to blend polyphenylene ethers with polyamides. However, polyphenylene ether and polyamide resins, having different polar characteristics and crystallinity, are not compatible and do not form miscible blends. Therefore, mere blending of the two polymers results in a phase-separated polymer aggregate that does not exhibit useful properties of either polymer.

Various molding compositions of polyphenylene ether/polyamide blend are described in the prior references, including U.S. Pat. No. 3,379,792 to Finholts, U.S. Pat. No. 4,315,086 to Ueno et al., and U.S. Pat. No. 4,732,938 to Grant et al. However, the use of polyphenylene ether/polyamide blends for monofilament applications has not been considered in the prior art. This is because a polyphenylene ether/polyamide blend monofilament composition requires substantially higher compatibility of the two polymers than the compatibility level attained in the prior art molding resin compositions. The compatibility of the two polymers in a polyphenylene ether/polyamide blend for traditional molding applications need not be so high as to form a completely miscible blend. Therefore, the prior art molding compositions may contain relatively large domains of one polymer within the continuous matrix of the other polymer. Such a partially compatible polyphenylene/polyamide blend cannot be used to produce monofilaments since the production of dimensionally uniform monofilaments is difficult and the resulting monofilaments do not have uniform physical properties throughout the entire length of the filaments. It is therefore necessary that the two polymers be highly compatible and the blend composition of the two resins be homogeneous in order to produce a quality monofilament.

The compatibilizer compound of the present invention is a compound or a group of compounds having one or more of functional moieties that react with phenylene ether polymers to functionalize polyphenylene ethers, whereby the functionalized polyphenylene ethers become compatible with polyamides. The preferred compatibilizer compounds include ethylenically unsaturated polycarboxylic acids, and anhydrides, esters, epoxies, amides and imides analogs thereof. The preferred compatibilizer compounds include fumaric acid, maleic acid, itaconic acid, dimethylmaleate, maleimide, tetrahydrophthalimide, maleic anhydride, itaconic anhydride, glutaconic anhydride, citraconic anhydride, tetrahydrophthalic anhydride, and the like; the more preferred are fumaric acid, maleic acid, maleic anhydride, and itaconic anhydride.

One further component of the monofilament of the present invention is a functionalized olefinic elastomer. An olefinic elastomer is defined as having an ASTM-638 tensile modulus of less than about 40,000 psi (276 MPa), typically less than 25,000 psi (172 MPa), and preferably less than 20,000 psi (138 MPa.). Useful olefinic elastomers include block and graft elastomers of one or more of ethylene, propylene, butylene, isopropylene and isobutylene. These elastomeric polymers may be produced by any of the well known methods (e.g., emulsion polymerization, solution polymerization) using any of the well known catalysts (e.g., peroxides, trialkylaluminum, lithium halides, and nickel catalysts). Of these useful olefinic elastomers, the preferred elastomers of the present invention includes copolymers of ethylene and an $\alpha$-olefin other than ethylene copolymer having, based on the ethylene, from about 30 to about 60 weight percent of the $\alpha$-olefin, such as ethylene/propylene rubber, ethylene/1-butene rubber, ethylene/butadiene rubber and the like, and blends thereof. The most preferred is ethylene/propylene rubber.

According to the present invention, the olefinic elastomer is functionalized with carboxyl or carboxylate functionalities. The functionality can be supplied by reacting the olefinic elastomer with an unsaturated graft moiety taken from the class consisting of $\alpha,\beta$-ethylenically unsaturated dicarboxylic acids having from 4 to 8 carbon atoms and derivatives thereof. Illustrative of such acids and derivatives are maleic acid, maleic anhydride, maleic acid monoethyl ester, metal salts of maleic acid monoethyl ester, fumaric acid, fumaric acid monoethyl ester, itaconic acid, vinyl benzoic acid, vinyl phthalic acid, metal salts of fumaric acid monoethyl ester, monoesters of maleic, fumaric or itaconic acids where the alcohol is methyl, propyl, isopropyl, butyl, isobutyl, hexyl, cyclohexyl, octyl, 2-ethyl hexyl, decyl, stearyl, methoxy ethyl, ethoxy ethyl, hydroxy ethyl, and the like. The functional moiety can be grafted to the olefinic elastomers by any graft processes known to the art, including but not limited to the processes described in U.S. Pat. Nos. 3,481,910; 3,480,580, 4,612,155 and 4,751,270. In performing the graft-polymerization of the functional moiety to the elastomers, there have been utilized various methods for initiating the grafting polymerization process such as $\gamma$-ray, X-ray or high-speed cathode ray irradiation processes, and a free-radical initiator process. The preferred functionalized olefinic elastomer of the present invention contains from about 0.1% to abut 3% by weight of the function moiety, more preferably from about 0.2% to about 2%.

The monofilament composition may also contain one or more conventional additives such as stabilizers and inhibitors of oxidative, thermal, and ultraviolet light degradation, lubricants, colorants, including dyes, and pigments, flame-retardants, plasticizers, finishers and the like.

The monofilament of the present invention may be prepared by conventional polymer melt-blending techniques that blend or mix the constituents to form a uniform dispersion in the presence of from about 0.01 weight % to about 0.2 weight %, more preferably from about 0.05 weight % to 0.1 weight %, of a free-radical initiator. All of the constituents may be mixed simultaneously or separately utilizing the mixing means well known in the art, such as a mixer or extruder. Although the polyphenylene ether component of the composition may be reacted with the compatibilizer compound prior to blending the rest of the constituents in order to increase the functionality of polyphenylene ether, the preferred method is blending or mixing all constituents in one step in order to simplify the production process. In addition, the monofilaments can be produced by a continuous or multi-step process. One of suitable methods for producing the present monofilament is the traditional two-step method, which method comprises melt-kneading a previously dry-blended composition further in a heated extruder provided with a single-screw, or in the alternative, a plurality of screws, extruding the uniform composition into strands in the presence of a free-radical initiator, such as benzoyl peroxide, tert-butyl peroxybenzoate, N-bromosuccinimide, or cumene hydroperoxide, chopping the extruded strands into pellets, and subsequently melt-extruding the pellets in an extruder equipped with a monofilament die to form monofilaments. In an alternative and preferred method, the dry-blended constituents of the composition is provided to a monofilament forming apparatus which comprises a heated extruder having at least a single screw. The heated extruder melt-blends the monofilament composition. The molten and thoroughly blended monofilament composition is fed into a metering pump which forces the molten composition through a die to from molten filaments. The resulting filament is quenched in a waterbath so as to form a solid filament. This continuous method is preferred as it provides an overall reduction of process and handling steps necessary to form a useful monofilament therefrom. The resulting monofilament is subsequently stretch oriented to impart physical strength. The monofilament is, in general, heated to a temperature near the softening point of the monofilament composition and then stretched to a draw ratio of from about 3:1 to 6:1. The drawn monofilament is quenched before being subjected to a relaxing procedure. The relaxing procedure comprises reheating the drawn monofilament, allowing it to relax up to about 15% and quenching to form the finished monofilament.

The resulting monofilament can be fabricated into different industrial conveyer belts of various designs and uses. For example, the monofilament can be fabricated into the felts for use in papermaking machines. Numerous designs for such felts are well known in the art, which include U.S. Pat. No. 3,613,258 to Jamieson et al., U.S. Pat. No. 4,119,753 to Smart, U.S. Pat. No. 4,427,734 to Johnson, U.S. Pat. No. 4,973,512 to Stanley et al., and U.S. Pat. No. 4,995,429 to Kositzke. A felt fabricated from the monofilament of the present invention provides dimensional stability, abrasion and chemical resistances, resiliency, and tenacity, making the felt suitable for use in papermaking machines. The felt of the instant invention is particularly suitable as a press felt for the wet-press section of papermaking machines. In addition, the instant felt exhibits a high thermal stability, rendering the felt suitable for use in the dryer section of papermaking machines as well as in other conveyer belt applications where the belt is exposed to harsh temperature and chemical environments.

The present invention is more fully illustrated by the following example, which is given by way of illustration and not by way of limitation of the invention.

EXAMPLE

Dry poly(2,6-dimethyl-1,4-phenylene ether) having 0.51 intrinsic viscosity was intimately blended with nylon 6, fumaric acid, a maleated ethylene/propylene rubber, and N-bromosuccinimide at a weight ratio of 47.75:47:5:0.5:0.05, respectively. A nylon 6 resin having a formic acid viscosity of about 58 and a molecular weight of about 25,000 was employed, which is available from Allied-Signal Inc. The maleated ethylene/propylene rubber used is available from Exxon Chemical under the trademark Exxelor ® 1803, which rubber contains from 0.5 to 0.9 weight % of maleic anhydride. The blended composition was extruded in a Werner & Pfleiderer ZSK 40 mm twin screw extruder equipped with nine separately heated barrel zones and one die. The extruder temperature profile was 240° C. for zone 1, 280° C. for zones 2–5, 260° C. for zones 6–9, and the die was kept at 275° C. The extruder pressure was 6.89 MPa (1000 psi). The resulting polyphenylene ether/polyamide blend composition was pelletized.

Subsequently, the polyphenylene ether/polyamide pellet was extruded in a single screw extruder, having three zones, equipped with a monofilament die. The temperature profile was 264° C. for zone 1, 266° C. for zones 2–3 and 266° C for the die. The resulting continuous monofilament was quenched in a waterbath then subjected to a stretch orientation process. The orientation process consisted of drawing and relaxing procedures. The drawing procedure was accomplished by passing the monofilament through a tension roll operated at 20 meters per minute (MPM), an oven heated to 177° C., a draw roll press operated at 61 MPM, an oven heated to 221° C., and a draw roll press operated at 63 MPM, in sequence. The resulting drawn monofilament was subjected to a relaxing procedure by passing it through an oven heated to 229° C. and a relax roll press operated at 58 MPM. The resulting monofilament was oriented to a draw ratio of 4:1 and had a diameter of 0.02 cm (0.008 inches).

The breaking tenacity of the monofilament, measured in accordance with the ASTM 2256-90 testing procedure, was 3.5 gram/denier, indicating that the polyphenylene ether/polyamide monofilament composition of the present invention is a highly compatible blend composition that has a good physical strength and that the resulting monofilament is an excellent monofilament useful for various industrial conveyer belt applications, especially for the papermaking machine felt applications.

The tensile modulus of the monofilament was measured, according to the ASTM 885-85 testing procedure at 70° F. and 65% relative humidity, on the dry-as-extruded and wet-conditioned monofilament samples. The wet-conditioned samples were prepared by submerging the monofilament samples in a waterbath at room temperature for varied durations. The results are shown in the table below.

TABLE

| Sample/Condition | Tensile Modulus (gram/denier) |
|---|---|
| Dry-As-Extruded: | 32.1 |
| Wet-Conditioned: | |
| 2 hours | 26.8 |
| 24 hours | 26.5 |
| 48 hours | 26.7 |

As can be seen from the above, the tensile modulus of the monofilament of the present invention does not change, after the initial drop, even when it is submerged in water for an extended duration. This is an unexpected advantage of the instant monofilament since the high content of nylon in the composition was expected to render the monofilament to be highly moisture sensitive and the amount of moisture absorbed by the monofilament to be proportional to the duration of exposure to moisture.

As discussed before and can be seen from the above example, the instant monofilament offers dimensional stability, abrasion resistance, chemical resistance, hydrolysis resistance and high temperature stability as well as strength and tenacity, rendering the monofilament to be an excellent polymeric material for use in industrial conveyer belt applications, especially where the belt is exposed to chemically and thermally harsh environments, such as the felts for papermaking machines.

What is claimed is:

1. A monofilament comprising, based on the total weight of the monofilament:

(a) from about 70 weight % to about 30 weight % of a polyphenylene ether;

(b) from about 30 weight % to about 70 weight % of a polyamide;

(c) from about 0.1 weight % to about 2.0 weight % of a compatibilizer compound for (a) and (b); and (d) from about 1 weight % to about 35 weight % of an olefinic elastomer functionalized with carboxyl or carboxylate functionalities;

wherein the monofilament has a breaking tenacity of at least 3.5 grams per denier.

2. The monofilament according to claim 1, wherein said polyphenylene ether is selected from the group consisting of poly(2,6-dimethyl-1,4-phenylene ether), poly (2-methyl-1,4-phenylene ether), poly (3-methyl-1,4-phenylene ether), poly(2,6-diethyl-1,4-phenylene ether), poly (2,6-dipropyl-1,4-phenylene ether), poly(2-methyl-6-alkyl -1,4-phenylene ether), poly(2,6-dichloromethyl-1,4-phenylene ether), poly(2,3,6-trimethyl-1,4-phenylene ether), poly (2,3,5,6-tetramethyl-1,4-phenylene ether), poly(2,6-dichloro-1,4-phenylene ether), poly(2,6-diphenyl-4-phenylene ether), poly(2,5-dimethyl-1,4-phenylene ether), and blends and copolymers thereof.

3. The monofilament according to claim 2, wherein said polyphenylene ether is poly(2,6-dimethyl-1,4-phenylene ether).

4. The monofilament according to claim wherein said polyamide is selected from the group consistinq of nylon 6, nylon 6,6, and blends and copolymers thereof.

5. The monofilament according to claim 4, wherein said polyamide is nylon 6.

6. The monofilament according to claim 1, wherein said compatibilizer compound is selected from the group consisting of fumaric acid, maleic acid, itaconic acid, dimethylmaleate, maleimide, tetrahydrophthalimide, maleic anhydride, itaconic anhydride, glutaconic anhydride, citraconic anhydride, and tetrahydrophthalic anhydride.

7. The monofilament according to claim wherein said functionalized olefinic elastomer is selected from the group consisting of copolymers of ethylene and an α-olefin other than ethylene copolymer.

8. The monofilament according to claim 7, wherein said functionalized olefinic elastomer is an ethylene/-propylene rubber.

9. The monofilament according to claim 1, wherein said functionalized olefinic elastomer is functionalized with a functional moiety selected from the group consisting of α,β-ethylenically unsaturated dicarboxylic acids having from 4 to 8 carbon atoms and derivatives thereof.

10. The monofilament according to claim 9, wherein said functionalized olefinic elastomer is functionalized with a functional moiety selected from the group consisting of maleic acid, maleic anhydride, maleic acid monoethyl ester, metal salts of maleic acid monoethyl ester, fumaric acid, fumaric acid monoethyl ester, itaconic acid, vinyl benzoic acid, vinyl phthalic acid, metal salts of fumaric acid monoethyl ester, monoesters of maleic, fumaric or itaconic acids where the alcohol is methyl, propyl, isopropyl, butyl, isobutyl, hexyl, cyclohexyl, octyl, 2-ethyl hexyl, decyl, stearyl, methoxy ethyl, ethoxy ethyl, and hydroxy ethyl.

11. A felt from a monofilament comprising, based on the total weight of the monofilament.

(a) from about 70 weight % to about 30 weight % of a polyphenylene ether;

(b) from about 30 weight % to about 70 weight % of a polyamide;

(c) from about 0.1 weight % to about 2.0 weight % of a compatibilizer compound for (a) and (b); and (d) from about 1 weight % to about 35 weight % of an olefinic elastomer functionalized with carboxyl or carboxylate functionalities;

wherein the monofilament has a breaking tenacity of at least 3.5 grams per denier.

12. The felt according to claim 11, wherein said polyphenylene ether is selected from the group consisting of poly(2,6-dimethyl-1,4-phenylene ether), poly (2-methyl-1,4-phenylene ether), poly (3-methyl-1,4-phenylene ether), poly(2,6-diethyl-1,4-phenylene ether), poly (2,6-dipropyl-1,4-phenylene ether), poly(2-methyl-6-alkyl -1,4-phenylene ether), poly(2,6-dichloromethyl-1,4-phenylene ether), poly(2,3,6-trimethyl-1,4-phenylene ether), poly (2,3,5,6-tetramethyl-1,4-phenylene ether), poly(2,6-dichloro -1,4-phenylene ether), poly(2,6-diphenyl-1,4-phenylene ether), poly(2,5-dimethyl-1,4-phenylene ether), and blends and copolymers thereof.

13. The felt according to claim 11, wherein said polyamide is selected from the group consisting of nylon 6, nylon 6,6, and blends and copolymers thereof.

14. The felt according to claim 11, wherein said compatibilizer compound is selected from the group consisting of fumaric acid, maleic acid, itaconic acid, dimethylmaleate, maleimide, tetrahydrophthalimide, maleic anhydride, itaconic anhydride, glutaconic anhydride, citraconic anhydride, and tetrahydrophthalic anhydride.

15. The felt according to claim 11, wherein said functionalized olefinic elastomer is selected from the group consisting of copolymers of ethylene and an α-olefin other than ethylene copolymer.

16. The felt according to claim 11, wherein said functionalized olefinic elastomer is functionalized with a functional moiety selected from the group consisting of $\alpha,\beta$-ethylenically unsaturated dicarboxylic acids having from 4 to 8 carbon atoms and derivatives thereof.

17. The felt according to claim 11, wherein said felt is a papermaking machine felt.

18. A papermaking machine felt formed from a monofilament comprising, based on the total weight of the monofilament:

(a) from about 70 weight % to about 30 weight % of poly(2,6-dimethyl-1,4-phenylene ether);

(b) from about 30 weight % to about 70 weight % of nylon 6;

(c) from about 0.1 weight % to about 2.0 weight % of a compatibilizer comopund for (a) and (b) selected from the group consisting of fumaric acid, maleic acid, maleic anhydride, and itaconic anhydride; and (d) from about 1 weight % to about 35 weight % of a maleic anhydride functionalized ehtylen/propylene rubber;

wherein the monofilament has a breaking tenacity of at least 3.5 grams per denier.

* * * * *

UNITED STATES PATENT AND TRADEMARK OFFICE

CERTIFICATE OF CORRECTION

PATENT NO. : 5,225,270

DATED : July 6, 1993

INVENTOR(S) : Y.M. Bhoori et al.

It is certified that error appears in the above-identified patent and that said Letters Patent is hereby corrected as shown below:

In Claim No. 7, column 10, line 4, "according to claim wherein" should read --according to claim 1 wherein--.

In Claim No. 18, column 12, line 4, "comopund" should read --compound--.

In Claim No. 18, column 12, line 9, "ethylen" should read --ethylene--.

Signed and Sealed this

Twenty-fourth Day of May, 1994

Bruce Lehman

BRUCE LEHMAN

*Commissioner of Patents and Trademarks*

*Attest:*

*Attesting Officer*